US005191854A

United States Patent [19]

Lehmann et al.

[11] Patent Number: 5,191,854

[45] Date of Patent: Mar. 9, 1993

[54] BOAT

[75] Inventors: Hans-Rudolf Lehmann, Solothurn; Marcel Lehmann, Balmweid 45, 4525 Balm b. Günsberg, both of Switzerland

[73] Assignee: Marcel Lehmann, Balm B. Günsber, Switzerland

[21] Appl. No.: 638,327

[22] Filed: Jan. 7, 1991

[30] Foreign Application Priority Data

Jan. 18, 1990 [CH] Switzerland ..... 00134/90
Jul. 13, 1990 [CH] Switzerland ..... 02355/90

[51] Int. Cl.[5] ..... B63B 1/04

[52] U.S. Cl. ..... 114/291; 114/56; 114/343; 114/362

[58] Field of Search ..... 114/56, 343, 355, 284, 114/362, 291; 14/71.1

[56] References Cited

U.S. PATENT DOCUMENTS

| | | | |
|---|---|---|---|
| 1,729,446 | 9/1929 | Maier | 114/56 |
| 2,601,836 | 7/1952 | Crewe | 114/284 |
| 2,980,924 | 5/1961 | Canazzi | 114/56 |
| 3,808,998 | 5/1974 | Molotzak | 114/284 |
| 3,808,999 | 5/1974 | Peterson | 114/56 |
| 3,996,869 | 12/1976 | Hadley | 114/56 |
| 4,083,320 | 4/1978 | Yost | 114/56 |

FOREIGN PATENT DOCUMENTS

| | | |
|---|---|---|
| 540053 | 11/1931 | Fed. Rep. of Germany . |
| 2029165 | 4/1971 | Fed. Rep. of Germany . |
| 2511969 | 3/1983 | France . |
| 12107 | of 1909 | United Kingdom . |
| 15977 | of 1909 | United Kingdom . |
| 1190172 | 4/1970 | United Kingdom . |
| 2047310 | 11/1980 | United Kingdom . |
| 1585865 | 3/1981 | United Kingdom . |

*Primary Examiner*—Sherman Basinger
*Assistant Examiner*—Thomas J. Brahan
*Attorney, Agent, or Firm*—Brady, O'Boyle & Gates

[57] ABSTRACT

The boat has a flap (1) forming a part of its V- or spoon-shaped bow and being unfoldable therefrom. This flap is supported by means of projections (*9a,9b*) arranged on both of its sides on swivel joints (*13a,13b*) set back into the inside of the boat with respect to the inner wall of the bow. Upon pivoting the flap (1) out of the bow opening (15), the flap is swung away from the bow wall portion with the uncovering of an interspace (2) between the flap and the bow wall portion which latter lies underneath the bow opening (15). The flap outside wall can be urged underneath the surface of the water and can be fixed in its position. The flap (1) is designed as a buoyant member, and when serving as a working or recreational platform, etc., can be folded back into the bow of the boat in such a way that the hydro- and aerodynamic properties as well as the esthetic appearance of the bow are not impaired. The boat according to this invention can thus be utilized, without restriction of its full functional ability, as a rescue boat, salvage boat, pleasure boat, and speedboat. The configuration of the flap (1) acting as a buoyant member makes its use possible without impairing the stability of the boat; in the unfolded condition, this configuration even enhances the capsizing stability of the boat. Furthermore, the design of the boat hull is such that the stern engines, when a curve is traversed, do not leave the water (4), and the boat exhibits a very high capsizing stability.

11 Claims, 3 Drawing Sheets

BOAT

The invention relates to a boat with a hinged front opening closure portion that forms part of a V-shaped or spoon-shaped bow.

Boats of this type are to be distinguished from those wherein a planar flap is arranged by means of a hinge in a planar portion of the boat wall, as, for example, in DOS 2,029,165. Those boats have the disadvantage of a hydrodynamically unfavorable driving characteristic.

A boat of the type mentioned above has been known from French Patent A-2,511,969. Also in this boat, as in those boats of a different type, care is taken to keep the flap, during pivoting, at all times in close contact with the wall of the boat. For this purpose, the flap bottom section has a recess sealingly engaged by the lower edge of the bow opening during the unfolding step. The bow section below the flap opening is adapted in its shape to the pivoting motion of the flap about its pivot axis, i.e. it is designed as a group of partial circles with the center of the circles being on the pivot axis. Therefore, the hull portion located below the bow opening can no longer be adapted to optimum flow conditions.

It is an object of the invention to provide a boat with a bow flap exhibiting good driving properties with an opened bow flap as well as in case of a closed bow flap.

Figure 1:
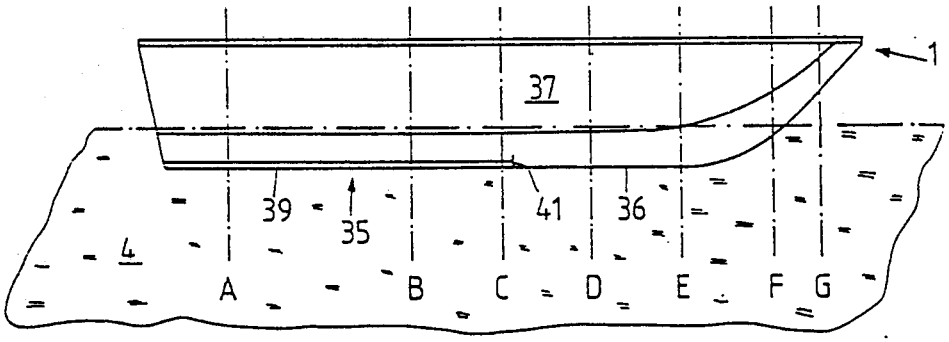
Figure 3:
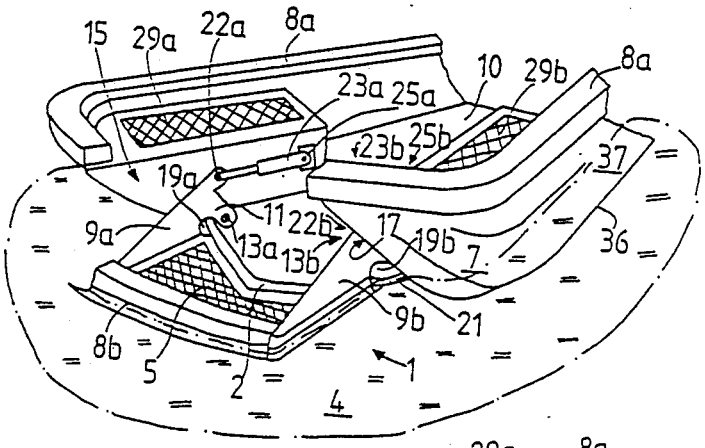
Figure 2:
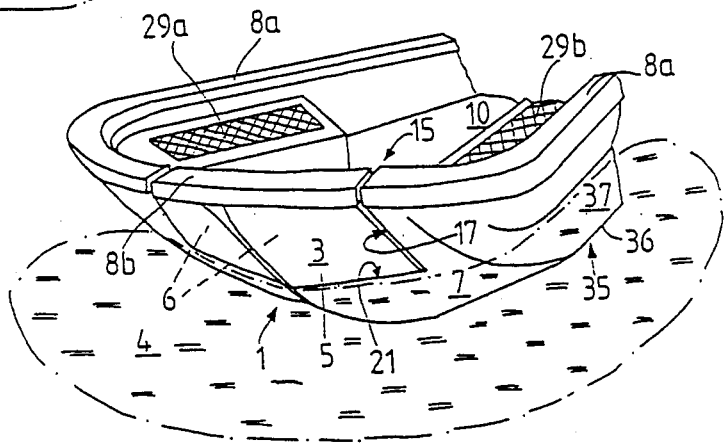
Figure 6:
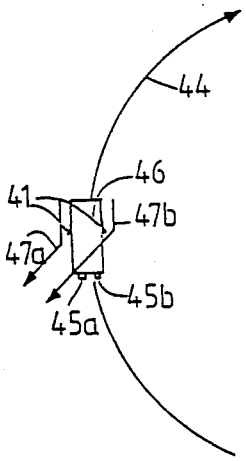
Figure 5:
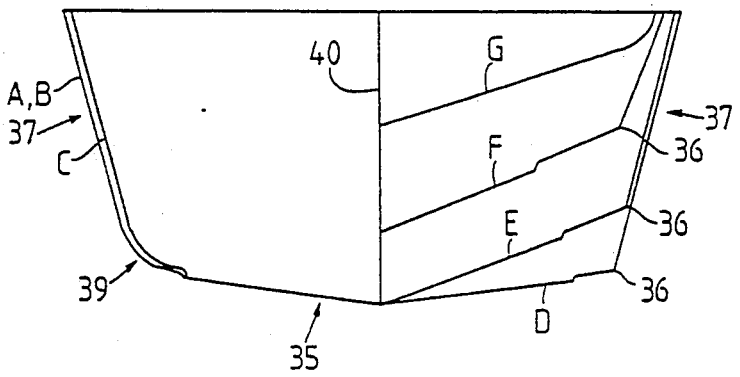
Figure 4:
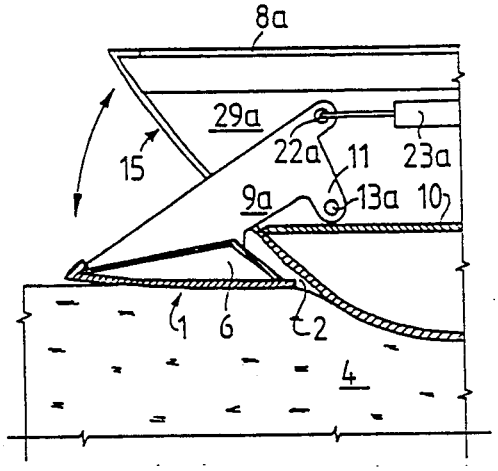
Figure 7:
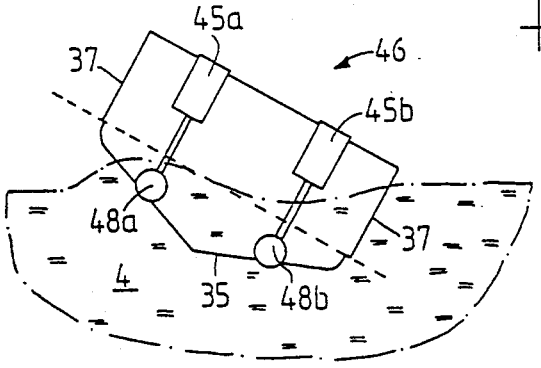
Figure 8:
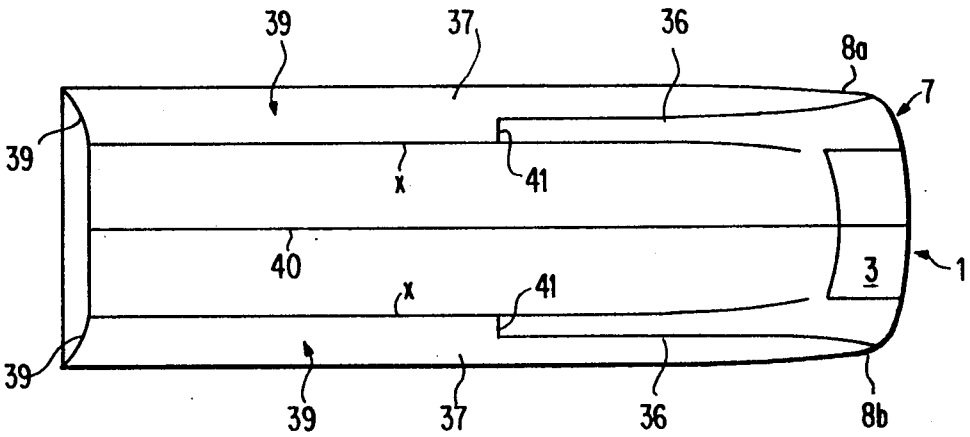

One example of a boat according to this invention will be described in greater detail below with reference to the drawings wherein:

FIG. 1 is a lateral view of a boat in accordance with this invention,

FIG. 2 is a perspective illustration of the bow of the boat shown in FIG. 1, with the bow flap being closed, FIG. 3 is a perspective view analogous to FIG. 2, but with the bow flap being swung out, FIG. 4 is a longitudinal section through the bow of the boat with the flap being unfolded, FIG. 5 shows views of the profiles of the boat illustrated in FIG. 1, FIG. 6 shows the boat while proceeding in a curve, FIG. 7 is a stern view of the boat shown in FIG. 6 while proceeding along a curve, and FIG. 8 is a bottom plan view of the boat.

The boat, illustrated in a lateral view in FIG. 1, has a flap 1 arranged symmetrically to the boat center line in its bow shown in FIG. 2; the bow has a V or spoon shape in which the apex of the V-S contour is outwardly convex and a convex configuration in the longitudinal direction of the boat. The hinged flap or bow closure position 1 is shown in FIGS. 3 as well as 4 in a position swung outwardly and downwardly from a U-shaped bow opening 15 that is open up to the top skirting or rub rail 8*a* of the boat, the outer wall 3 of the flap 1 being partially immersed in the water 4 in its open position as shown.

The outside wall 3 of the flap 1 is likewise curved in a spoon shape and is designed so that, in the closed position, its outer shape continues into the outer bow wall 7 in an aero- and hydrodynamic fashion. On account of this configuration, it acts, when partially immersed in the water 4, as a flow-exposable plate with good hydrodynamic properties so that the boat can be operated even with a deployed flap 1 partially immersed in the water, in which case the flap 1 then lifts the bow. When flap 1 is moved to its open position, as shown in FIGS. 3 and 4, the lower portion of flap 1 adjacent to the water is moved underneath the surface of the water 4 and underneath and spaced from the bow wall portion lying below the bottom edge of the U-shaped bow opening 15 that is adjacent to the water surface. An open space 2 is thus formed, as shown in FIG. 4, between the lower portion of flap 1 and the bow wall portion lying below the bow opening 15 when flap 1 is in the open position. This arrangement acts as a well-known water-jet aspirator, because the streaming water on the outside wall 3 of the swung out open flap 1, when the boat moves forward in the water, sucks air and water if it is present from the inner side of the flap 1 down through the open space 2. Air is sucked underneath the boat hull through this open space 2 whereby, on the one hand, penetration of water 4 is prevented and, on the other hand, the sliding friction of the boat hull is reduced. The opened flap 1 furthermore generates additional buoyancy for the boat by its configuration as well as by a closed cavity 6 located between the flap outside wall 3 and inside wall 5; this cavity is illustrated in FIG. 4 in the section through the flap 1. The rub rail 8*a* of the boat is also continued in the flap 1 and serves here as a bumper edge 8*b* and as flap reinforcement. If the flap 1 is utilized as a loading ramp and/or landing ramp, as described below, then the bumper edge 8*a* is altered with respect to the configuration shown in FIGS. 2 and 3, in correspondence with its purpose of use.

The flap 1, as can be seen in FIG. 3, has connected thereto, on its inside wall 5 on both sides adjacent to the portside and the starboard side of the boat respectively one projection 9*a* and 9*b* lying in parallel to the axis of the boat. Each projection 9*a* and 9*b*, respectively, has a transom 11 oriented toward the bottom 10 of the boat, by way of which the flap 1 is hingedly supported on respectively one swivel joint 13*a* and 13*b* at the inside of the boat in the proximity of the bow opening 15 directly above the boat bottom 10. The pivoting axis of the flap is set back by a certain distance toward the center of the boat with respect to the generally vertically inclined bow wall edge 17 and the bottom edge 21 of the U-shaped bow opening 15 adjacent to the water surface. Each transom 11 is positioned relative to the respective projection 9*a*, 9*b* to provide a respective downwardly open recess 19*a* and 19*b* in projections 9*a*, 9*b*, respectively, open toward the inside wall 5 of flap 1 between its swivel joint 13*a* and 13*b* and the connection of the respective projection 9*a*, 9*b* to the inside wall 5 of flap 1. As shown in FIGS. 2, 3 and 4, the recesses 19*a* and 19*b* are formed so that the lower edge of flap 1 lying adjacent to the bottom edge 21 of the U-shaped bow opening 15 when the flap 1 is in its closed position, can be moved out of the bow opening 15 and underneath the bow wall portion or bow region adjacent to or below the bottom edge 21 of the bow opening 15, as shown in FIG. 4. The flap 1 is moveable from its closed to its open position as shown in the FIGS. 2, 3 and 4, whereby in its open position the above mentioned open space 2 is provided between the lower edge of flap 1 and the bow wall portion lying below and adjacent to the bottom edge 21 of the U-shaped bow opening 15, as shown in FIG. 3. During the downward pivoting of the flap 1, the bottom edge 21 of the U-shaped bow opening 15 moves into the recesses 19*a* and 19*b*.

At a spacing above the swivel joint 13*a* and 13*b*, respectively, the piston end of a dual-acting piston-cylinder unit 23*a* and 23*b*, i.e. a unit exerting tension and pressure, is supported on a bearing 22*a* and 22*b* of the projection 9*a* and 9*b*, respectively. The base 25*a* or 25*b* of the piston-cylinder unit 23*a* or 23*b* is pivotably mounted to the inside of the boat at approximately the same level as the piston bearing. Electromechanical adjusting devices can likewise be employed in place of the piston-cylinder units.

As described above, the flap 1 has a cavity 6 on the inside in order to attain additional buoyancy when the flap 1 is partially urged into the water by the piston-cylinder units 23*a* and 23*b*; such buoyancy, as described below, is of great benefits in diving work, swimming operation, or similar activities. Thereby, the bow is likewise urged upwards and accordingly can be burdened with additional loads. Buoyancy is so great that one to two persons can readily position themselves on the opened flap 1 without impairing the stability of the boat. The flap 1 is arranged and supported in such a way that it can be swung into a position wherein the outside of the outer wall 3 of the flap 1 is located almost entirely below the waterline and the inside is approximately at the level of the waterline.

The outside bottom 35 of the boat has an angular transition 36 to the outer sidewall 37 of the boat, as shown in FIGS. 1, 5 and 8, and has a rounded transition 39 in its stern portion. The angular transition 36 passes over into the round transition 39 with an interruption 41 located approximately in the center of the length of the boat. Depending on requirements to be met by the boat, the interruption 41 can be arranged at a spacing of two-thirds of the entire boat length as seen from the bow of the boat.

The boat profile as well as, in particular, the rounded and angular transitions 36 and 39, respectively, are illustrated in FIG. 5. Since the boat profile extends symmetrically with respect to the center line 40, the illustration in each case shows merely one-half of the profile in order to avoid confusion in the drawing. The profiles with an angular transition 36 are shown on the right-hand side in FIG. 5, and the round transitions are illustrated on the left-hand side. Letters A through G denote the locations of the profiles as indicated in the lateral view of the boat in FIG. 1.

As can furthermore be seen from FIG. 5, the center of gravity of the boat lies at a very deep level, contributing toward the safety against capsizing as mentioned hereinbelow.

The above-described arrangement of the angular and rounded transitions 36 and 39 has proven itself well, in particular, when a boat 46 equipped with two stern engines 45*a* and 45*b* is operated to describe curves 44 on the water, as illustrated in FIGS. 6 and 7. By virtue of the angular transition 36, the water underneath the bottom 35 of the boat is channeled in parallel to the longitudinal axis of the boat. When a curve 44 is traversed, the boat 46 tilts toward the center of the curve, as shown in FIG. 7. Thereby, the water 4, as indicated by two schematic flow lines 47*a* and 47*b*, is conducted in the portion of the boat 46 on the bow side up to the interruption 41 in parallel to the axis of the boat toward the stern and, immediately downstream of the interruption 41, is bent away toward the outside underneath the boat 46. The interruptions 41, in contradistinction to the actual configuration as derivable from FIGS. 1 and 5, are drawn in FIG. 6 to project laterally for a better identification. On account of the design of the outside bottom 35 of the boat with an angular and round transition 36 and 39, respectively, as well as owing to the interruption 41, water 4 is conducted upwards to the propeller 48*a* of the stern engine 45*a*, which is lifted upwards on the left when a right-hand curve is traversed, whereupon this stern engine remains fully immersed in the water and can continue to transmit its full thrust power to the water. Due to the round transition 39, the boat slightly yields in a gliding fashion with its stern in the curve 44 whereby its curve radius is considerably reduced. With this design of the boat hull, an extremely accurate targeting of a desired approach location in a waterway is made possible, in order to then perform at this location, with the ramp 1 being extended, for example salvaging operations, taking on of swimmers, placing of divers, as well as driving into the proximity of a beach or a shore in order to disembark easily.

For the unfolding of the flap 1, the piston-cylinder units 23*a* and 23*b* are set to thrust by means of a control valve, not shown, whereby the flap section 1 is moved out of the bow toward the surface of the water. The flap 1 can be continuously adjusted by way of the piston-cylinder units 23*a* and 23*b* and can thereby be fixed in any angular position. The lowest pivoting point of the flap 1 is attained when the bumper edge 8*b*, as the upper flap edge, is just above the waterline. In this condition, the outer wall 3 of the flap is almost completely immersed in the water 4. Since the flap outer wall 3 is curved in the manner of a spoon, and its two sides are closed off by the projections 9*a* and 9*b*, the flap 1 urged into the water 4 acts as a buoyant body, alone due to its external configuration, and lifts the bow of the boat. If water 4 were to pass to the inside of the flap 1 on account of waves, or if the flap is loaded down with too great a weight, then the flap still acts as a buoyant body due to its cavity 6. On account of the rigid connection of the flap 1 with the remainder of the boat by way of the piston-cylinder units 23*a* and 23*b*, tipping is impossible even in case of an extremely high weight load on the flap 1. The buoyancy of the bow is additionally enhanced by lateral buoyant bodies 29*a* and 29*b*, as can be seen in FIGS. 2 and 3. These buoyant bodies 29*a* and 29*b* can include, as the topside, a door that can be swung out; also, the accessory equipment for the piston-cylinder units 23*a* and 23*b* can be accommodated therein.

Since the inner wall 5 of the swung-down flap 1 is located directly above the water level and, additionally, the flap 1 proper acts as a buoyant member, the swung-out flap 1, as already hinted at above, can be utilized as a platform for entering and leaving the water during diving and rescuing operations as well as other work performed on the water; also, this flap 1 can be utilized as a swimming platform. Rescuing of injured persons swimming in the water 4 and also salvage of flotsam floating in the water 4 can be accomplished in a simple way, since the injured person as well as the cargo can be readily pulled into the boat over the flap edge 8*b*.

The flap 1 can also be utilized as a landing ramp in case the boat is driven to the riverbank and the flap 1 is unfolded toward the bank. On account of the dual-acting piston-cylinder units 23*a* and 23*b*, the flap 1 remains fixed in the once-set angular position, no matter how the boat is moved by waves or varying loads.

In addition to or in place of the flap 1 in the bow, a flap can also be mounted at the stern or in one of the boat sidewalls. In case a flap is mounted in the sidewalls on the left-hand and right-hand sides, it can be utilized, in the deployed condition, as a working platform as well as a stabilizing outrigger. However, with flaps arranged in the lateral boat walls, the boat can be driven either not at all or only extremely slowly. A flap arranged at the stern requires a special structure of the boat driving mechanism. Outboard motors can then be installed only conditionally. Only one flap in the boat sidewall or at the stern would constitute a less advantageous embodiment of the invention.

One of the advantages of the boat according to this invention resides in that its flap 1, serving as a working or recreational platform, can be folded back into the bow wall in such a way that its hydro- and aerodynamic properties as well as its esthetic appearance are not impaired. The boat according to this invention thus can be utilized, without any restriction of its full functional ability, as a rescue boat, a salvage boat, a pleasure boat, and a speedboat. An additional advantage is to be seen in the configuration of the flap, acting as a buoyant member, the use of which is possible independently of stability problems of the boat; such configuration even increases, in the swung-out condition, the capsizing stability of the boat. The outer wall of the flap is designed so that, with the flap urged into the water and the boat going forward, the bow is pressed in the upward direction. On account of the open space 2 between the lower edge of the bow opening and the lower edge of the flap 1, this latter edge is displaced toward the front in the driving direction so that the water flowing along at this location evokes a suction effect with respect to the open space 2. Thereby, on the one hand, water cannot penetrate into the boat through the interspace open space 2; any water that may have entered would be removed by suction; and, on the other hand, air taken in by the suction effect is sucked underneath the boat hull whereby the water friction of the latter is reduced. On account of the structure of the flap according to this invention with the open space 2, as compared, for example, with the arrangement of a bow flap disclosed in French Patent 2,511,969, a significantly simpler structure that is safe in its operation is furthermore obtained since, for example, small contaminants, such as sand and dirt, cannot impair the closing and sealing step. Furthermore, the configuration of the boat hull as derivable from FIGS. 1 and 5, is designed so that capsizing of the boat is almost impossible.

We claim:

1. A boat with a stern and a bow comprising, a portside and a starboard boat side with an inner and an outer wall adjacent to the interior and exterior of the boat respectively, a bow opening (15) in said bow extending from the interior to the exterior of the boat, a bow outer wall portion underneath said bow opening (15), a flap (1) closing said bow opening (15) and forming part of said bow, means connected to move said flap (1) between a closed position closing said bow opening (15) and an open position pivoted out of said bow opening (15) in a direction exterior of the boat, said flap (1) having an inner and an outer wall, and a bottom edge portion, two bow side parts adjacent said bow opening (15) at said portside and said starboard boat side respectively having an inner and an outer wall, said outer wall of said flap (1) having a V-shaped contour, said outer walls of said two bow side parts and said outer wall of said flap (1), when said bow opening (15) is closed by said flap (1), forming a V-shaped bow, said means connected to move said flap (1) including at least one projection (9*a*, 9*b*) extending from said flap (1) into said interior of the boat, at least one swivel joint means (13*a*, 13*b*) set back into said interior of said boat relative to said inner wall of said flap (1), connecting said projection (9*a*, 9*b*) to the inner wall of the boat, and said swivel joint means (13*a*, 13*b*) and projection (9*a*, 9*b*) positioned so that when moving said flap (1) from the closed positioned to the open position to open said bow opening (15), said bottom edge portion of said flap (1) is moveable partly underneath said bow opening (15) forming an open space (2) between said bottom edge portion of said flap (1) lying underneath said bow opening (15) and said outer bow wall portion underneath said bow opening (15).

2. Boat according to claim 1, in which said means connected to move said flap (1) including adjusting means (23*a*, 23*b*) connected between said flap (1) and the interior of the boat, whereby said outer wall of said flap (1) is pivoted about said swivel joint means (13*a*, 13*b*) partly into the water (4), and said outer wall of said flap (1) being convex in the longitudinal direction of said boat, whereby when said boat is moved in the water in the forward direction the bow is lifted and water and air is sucked through said open space (2) to underneath the boat hull.

3. A boat according to claim 2, in which said means connected to move said flap (1) including adjusting means (23*a*, 23*b*) connected between said flap (1) and the interior of the boat and being operable to press at least said outer wall (3) of said flap (1) partly underneath the surface of said water to increase the buoyancy of said boat when at a standstill as well as when moving, and being operable to fix said flap (1) in its extended open position.

4. A boat according to claim 3, in which said adjusting means (23*a*, 23*b*) comprise at least one dualacting piston-cylinder unit having opposite ends, one end (25*a*, 25*b*) of said piston-cylinder unit connected to said inner wall of said boat, a bearing on said at least one projection (9*a*, 9*b*), the opposite end (22*a*, 22*b*) of said piston-cylinder unit connected to said bearing on said at least one projection (9*a*, 9*b*).

said bearing being spaced such a distance from said swivel joint means (13*a*, 13*b*) on said projection (9*a*, 9*b*) to allow said outer wall (3) of said flap (1) to be moved outwardly to a position wherein the outer wall 3 would be at least partly underneath the surface of the water (4), and to be moved inwardly to said closed position in which said flap (1) moves into and closes said bow opening (15).

5. A boat according to claim 1, in which said flap (1) is constructed as buoyant means to generate additional buoyancy for said boat when said flap (1) is partly immersed into the water (4).

6. A boat according to claim 1, in which said flap (1) includes at least one totally closed cavity (6) acting as a buoyant means which generate additional buoyancy for said boat when said flap (1) is partly immersed into the water (4).

7. A boat according to claim 1, including top skirting (8*a*, 8*b*) on said bow side parts adjacent said bow opening (15), said bow opening (15) is U-shaped and open to said top skirting (8*a*, 8*b*) of the boat, and said U-shaped bow opening (15) having a bottom edge (21) positioned, when the boat is in water (4), to be adjacent to the surface of the water (4), said projections (9*a*, 9*b*) including a connecting portion connected to said inner wall (5) of said flap (1), an edge recess (19*a*, 19*b*) in said projection (9*a*, 9*b*) positioned between said connecting portion and said swivel joint (13*a*, 13*b*) connection on said projection (9*a*, 9*b*), and said edge recess being open in the direction toward said flap (1) and being formed so that said bottom edge (21) enters into said edge recess (19*a*, 19*b*) when said flap (1) is swung out to the open position, whereby said bottom edge portion of said flap (1) is partly pivoted underneath the surface of the water and underneath said bottom edge (21) of said bow opening (15) and underneath the outer bow wall portion underneath said bottom edge (21).

8. A boat according to claim 1 in which said V-shaped contour of said outer wall of said flap (1) is outwardly convex at the apex of said V-shaped contour.

9. A boat having a bow, a stern, a propeller engine mounted at the stern, an outside bottom hull (35) with a blunt cornered keel, a portside outer wall (37) and a starboard side outer wall (37) forming an outside hull with said outside bottom hull (35), the outside hull having a bow portion extending rearwardly from said bow and a sternside portion extending forwardly from said stern, and a medial portion between said bow portion and said sternside portion, comprising an angular transition (36) connecting said outside bottom hull (35) and said portside outer wall (37), and connecting said outside bottom hull (35) and said starboard side outer wall (37), respectively, at the bow portion of said boat outside hull, a round transition (39) connecting said outside bottom hull (35) and said portside outer wall (37), and connecting said outside bottom hull (35) and said starboard side outer wall (37), respectively, at the sternside portion of said boat outside hull, and said angular transition (36) passing over into said round transition (39) at said medial portion of said boat outside hull, whereby the maneuvering curve radius of the boat is decreased enabling the bow to be maneuvered with greater accuracy to a desired target.

10. A boat according to claim 9, including an abrupt interruption means (41) on the portside outer wall (37) and on the starboard side outer wall (37) of said medial portion between said angular transition (36) and said round transition (39), said abrupt interruption means (41) being an abrupt end of said angular transition (36) along said bow portion and a beginning of said round transition (39) along said sternside portion and defining a laterally extending transition connection therebetween.

11. A boat according to claim 10, in which said boat outside hull has a longitudinal axis, said abrupt interruption means (41) arranged symmetrically to said longitudinal axis of said boat outside hull and positioned at the medial portion of said outside hull at a maximum distance of two-thirds of the entire length of said outside hull from said bow of said boat, whereby said bow portion comprises at the most two-thirds of the entire length of said boat.

* * * * *